United States Patent [19]

Fujimoto et al.

[11] Patent Number: 4,753,210

[45] Date of Patent: Jun. 28, 1988

[54] FUEL INJECTION CONTROL METHOD FOR INTERNAL COMBUSTION ENGINES AT ACCELERATION

[75] Inventors: Sachito Fujimoto; Makoto Hashiguchi, both of Wako, Japan

[73] Assignee: Honda Giken Kogyo K.K., Tokyo, Japan

[21] Appl. No.: 80,345

[22] Filed: Jul. 31, 1987

[30] Foreign Application Priority Data

Oct. 31, 1986 [JP] Japan ..... 61-261628

[51] Int. Cl.[4] ..... F02B 3/00

[52] U.S. Cl. ..... 123/492; 123/490

[58] Field of Search ..... 123/492, 490

[56] References Cited

U.S. PATENT DOCUMENTS 4,363,307 12/1982 Amano ..... 123/492
4,463,730 8/1984 Kishi ..... 123/492
4,469,074 9/1984 Takao ..... 123/492
4,490,792 12/1984 Deutsch ..... 123/492
4,508,085 4/1985 Yamoto ..... 123/492

*Primary Examiner*—Ronald B. Cox
*Attorney, Agent, or Firm*—Arthur L. Lessler

[57] ABSTRACT

A fuel injection control method for an internal combustion engine wherein synchronous fuel injection is effected in synchronism with control pulses generated at predetermined crank angle positions of the engine corresponding to suction strokes of respective engine cylinders to supply the engine with a quantity of fuel required for operating conditions of the engine, and when the engine is operating in a predetermined acceleration condition, asynchronous fuel injection is effected independently of the above control pulses to supply the engine with an additional quantity of fuel. The quantity of fuel to be supplied by the synchronous fuel injection is decreased by a predetermined amount immediately after the asynchronous fuel injection is effected. The predetermined amount of fuel corresponds to the quantity of fuel to be supplied by the asynchronous fuel injection.

7 Claims, 5 Drawing Sheets

FUEL INJECTION VALVE
4
5
6
2
9
10
PBA
7
θTH
1
INTERNAL COMBUSTION ENGINE
12
Ne
13
Tw
3
15
THREE-WAY CATALYST
14
O2
8
8a
8b
8c
8d
INPUT CIRCUIT MEANS
CPU
MEMORY MEANS
OUTPUT CIRCUIT MEANS
ECU

FUEL INJECTION CONTROL METHOD FOR INTERNAL COMBUSTION ENGINES AT ACCELERATION

BACKGROUND OF THE INVENTION

This invention relates to a fuel injection control method for internal combustion engines at acceleration, and more particularly to a method of this kind which is intended to improve the driveability of the engine upon acceleration thereof.

A fuel injection control method for internal combustion engines is known, e.g. by Japanese Provisional Patent Publication (Kokai) No. 58-202335, which is adapted to determine the fuel injection quantity in dependence on operating parameters of the engine indicative of operating conditions of the engine, and which includes two modes of fuel injection, i.e. synchronous fuel injection wherein a fuel quantity determined based upon engine rotational speed and intake pipe absolute pressure is supplied through injection into the engine upon generation of each of control pulses generated at predetermined crank angle positions corresponding to respective suction stroke of the cylinders, and asynchronous fuel injection wherein a fuel quantity depending upon an accelerating condition of the engine is supplied through injection into the engine at timing irrespective of the timing of generation of the above control pulses when the engine is being accelerated.

According to the above known method, the synchronous fuel injection is sequentially effected for each of the cylinders to supply a fuel quantity dependent upon engine rotational speed and intake pipe absolute pressure to each of the cylinders, and on the other hand, an accelerating condition of the engine is detected by sensing the opening of a throttle valve in an intake pipe of the engine, and upon detection of the accelerating condition the asynchronous fuel injection is effected for all the cylinders at the same time to supply an accelerating fuel increment corresponding to the degree of opening of the throttle valve to each of the cylinders at one time, to thereby improve the responsiveness of fuel increase as well as improve atomization of fuel at engine acceleration.

According to this manner of fuel injection, the synchronous fuel injection of an increased fuel quantity corresponding to the degree of acceleration takes place immediately following the asynchronous fuel injection. As a consequence, the engine is eventually supplied with an excess of fuel equal to the accelerating fuel increments in addition to the actually required amount of fuel, which results in the air-fuel ratio of the resulting mixture supplied to the engine becoming overrich and hence in degraded engine output, thus impeding smooth acceleration of the engine.

SUMMARY OF THE INVENTION

It is therefore the object of the invention to provide a fuel injection control method for an internal combustion engine at acceleration, which is capable of supplying the engine at acceleration with a suitable amount of fuel so as to ensure smooth increase in the engine output, thereby improving the driveability of the engine at acceleration.

In order to achieve the above object, the present invention provides a method of controlling the injection of fuel into an internal combustion engine having a plurality of cylinders, wherein synchronous fuel injection is effected in synchronism with control pulses generated at predetermined crank angle positions of the engine corresponding to suction strokes of respective ones of the cylinders to supply each of the cylinders with a quantity of fuel required for operating conditions of the engine, and when the engine is operating in a predetermined accelerating condition, asynchronous fuel injection is effected independently of the control pulses to supply each of the cylinders with an additional quantity of fuel.

The method according to the invention is characterized by comprising the step of decreasing the quantity of fuel to be supplied to said engine by the synchronous fuel injection, by a predetermined amount, immediately after the asynchronous fuel injection is effected.

Preferably, the predetermined amount of fuel corresponds to the quantity of fuel to be supplied by the asynchronous fuel injection.

Further preferably, the predetermined amount of fuel is equal to a product obtained by multiplying a basic value of the quantity of fuel to be supplied by the asynchronous fuel injection by a predetermined value.

The above predetermined accelerating condition of the engine is one taking place while the engine is in an idling condition.

The above and other objects, features and advantages of the invention will be more apparent from the ensuing detailed description taken in conjunction with the accompanying drawings.

DETAILED DESCRIPTION

The method according to the invention will now be described in detail with reference to the drawings showing an embodiment thereof.

Figure 1:
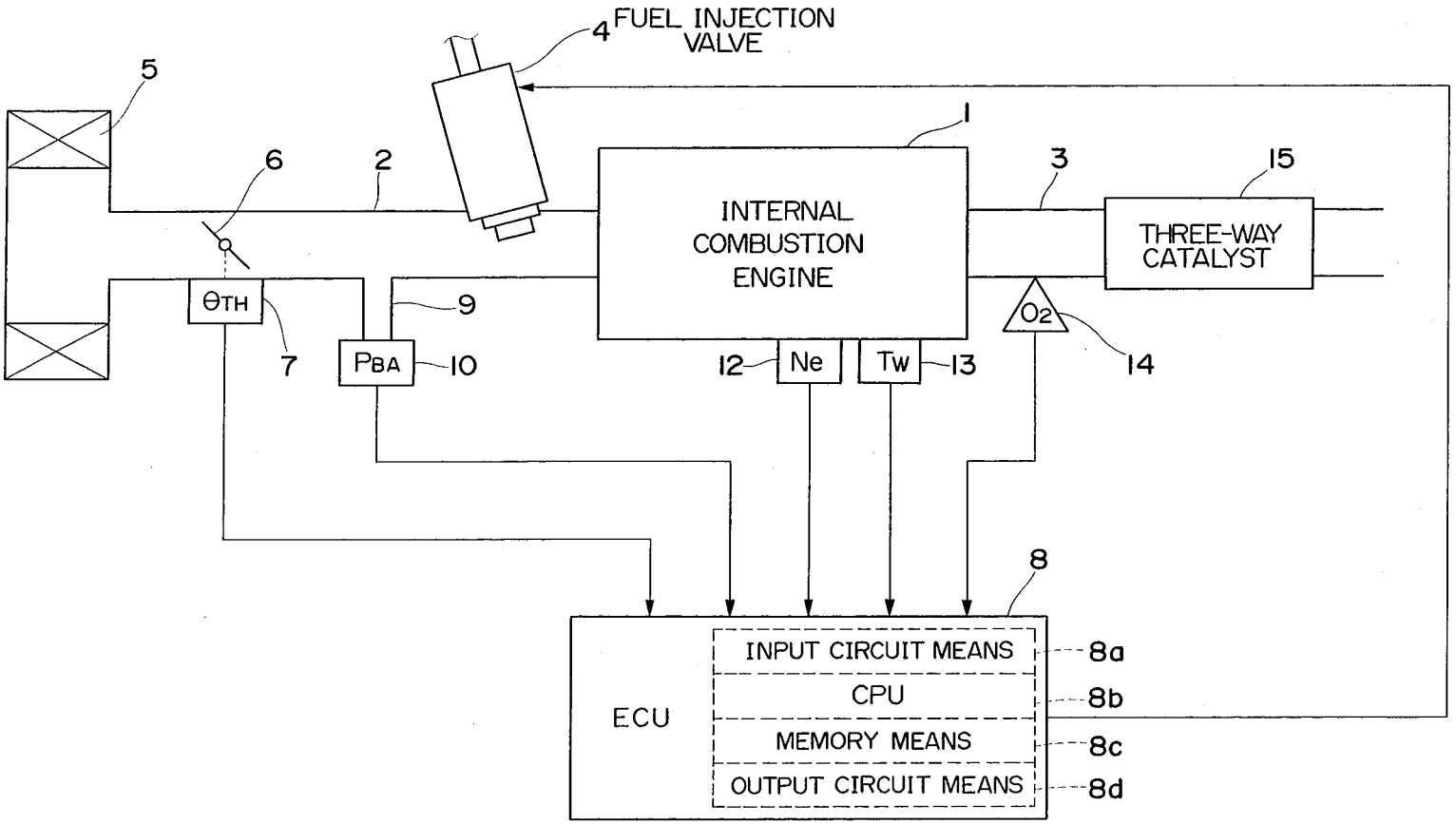
FIG. 1 is a block diagram illustrating the whole arrangement of a fuel injection control system for an internal combusiton engine, to which is applied the method according to the invention.

Referring first to FIG. 1, there is shown the whole arrangement of a fuel injection control system for an internal combustion engine, which carries out the method according to the invention. In the figure, reference numeral 1 designates an internal combustion engine for automotive vehicles, which may be a four-cylinder type. Connected to the engine 1 are an intake pipe 2 and an exhaust pipe 3, both communicating with a combustion chamber within each of the cylinders.

Fuel injection valves 4, only one of which is shown, are inserted into the interior of the intake pipe 2 at locations close to an end of the intake pipe 2 connected to the engine 1, with an opposite open end of the intake pipe 2 being provided with an air cleaner 5. Arranged in an intermediate portion of the intake pipe 2 is a throttle valve 6 to which is connected a throttle valve opening ($\theta$th) sensor 7. The sensor 7 is electrically connected to an electronic control unit (hereinafter called "the ECU") 8 to supply same with an elctric signal indicative of the sensed throttle valve opening.

An intake pipe absolute pressure (PBA) sensor 10 is communicated via a pipe 9 with the interior of the intake pipe 2, for sensing absolute pressure within the intake pipe 2 and supplying an electric signal indicative of the sensed absolute pressure to the ECU 8 to which it is electrically connected.

The fuel injection valves 4 are connected to a fuel pump, now shown, and electrically connected to the ECU 8 to have their valve opening periods controlled by driving signals from the ECU 8 so as to supply the engine 1 with suitable amounts of fuel.

The engine 1 has its cylinder block provided with an engine rotational speed (Ne) sensor 12 and an engine coolant temperature (TW) sensor 13, the sensors being electrically connected to the ECU 8 for supplying respective electric signals indicative of the sensed Ne and TW values thereto.

The engine rotational speed sensor 12 is adapted to generate a pulse of a crank angle position signal (hereinafter called "the TDC signal") at each of predetermined crank angles in advance of a top dead center (TDC) corresponding to the start of a suction stroke of each of the cylinders each time the engine crankshaft rotates through 180 degrees, pulses of the TDC signal being supplied to the ECU 8.

An $O_2$ sensor 14 is inserted into the interior of the exhaust pipe 3 for sensing the concentration of oxygen in exhaust gases emitted from the engine 1 and electrically connected to the ECU 8. Arranged in the exhaust pipe 3 at a location downstream of the $O_2$ sensor 14 is a three-way catalyst 15 for purifying HC, CO, and $NO_x$ components contained in the exhaust gases.

The ECU 8 comprises input circuit means 8*a* having functions, e.f. of shaping the waveforms of input signals from part of the aforementioned various sensors, shifting the levels of output voltages from part of the sensors into a predetermined level, and convering analog signals from part of the sensors into digital signals, a central processing unit (hereianfter called "the CPU") 8*b*, memory means 8*c* storing various control programs executed within the CPU 8*b* and for storing results of various computations also executed within the CPU 8*b*, and driving circuit means 8*d* for supplying driving signals to the fuel injection valves 4.

Engine operating parameter signals from the aforementioned various sensors are supplied to the CPU 8*b* through the input circuit means 8*a* of the ECU 8, and the CPU 8*b* determines operating conditions of the engine 1 from the engine parameter signals in accordance with a predetermined control program, hereinafter described, calculates a fuel supply quantity for the engine 1 in response to the determined operating conditions of the engine 1, that is, a fuel injection period according to synchronous fuel injection control synchronous with the TDC signal, as well as one according to asynchronous fuel injection control independent of the TDC signal, and supplies driving signals through the output circuit means 8*d* to the fuel injection valves 4 for energizing same.

The fuel injection control method at engine acceleration according to the invention will now be described with reference to FIG. 2.

Figure 2:
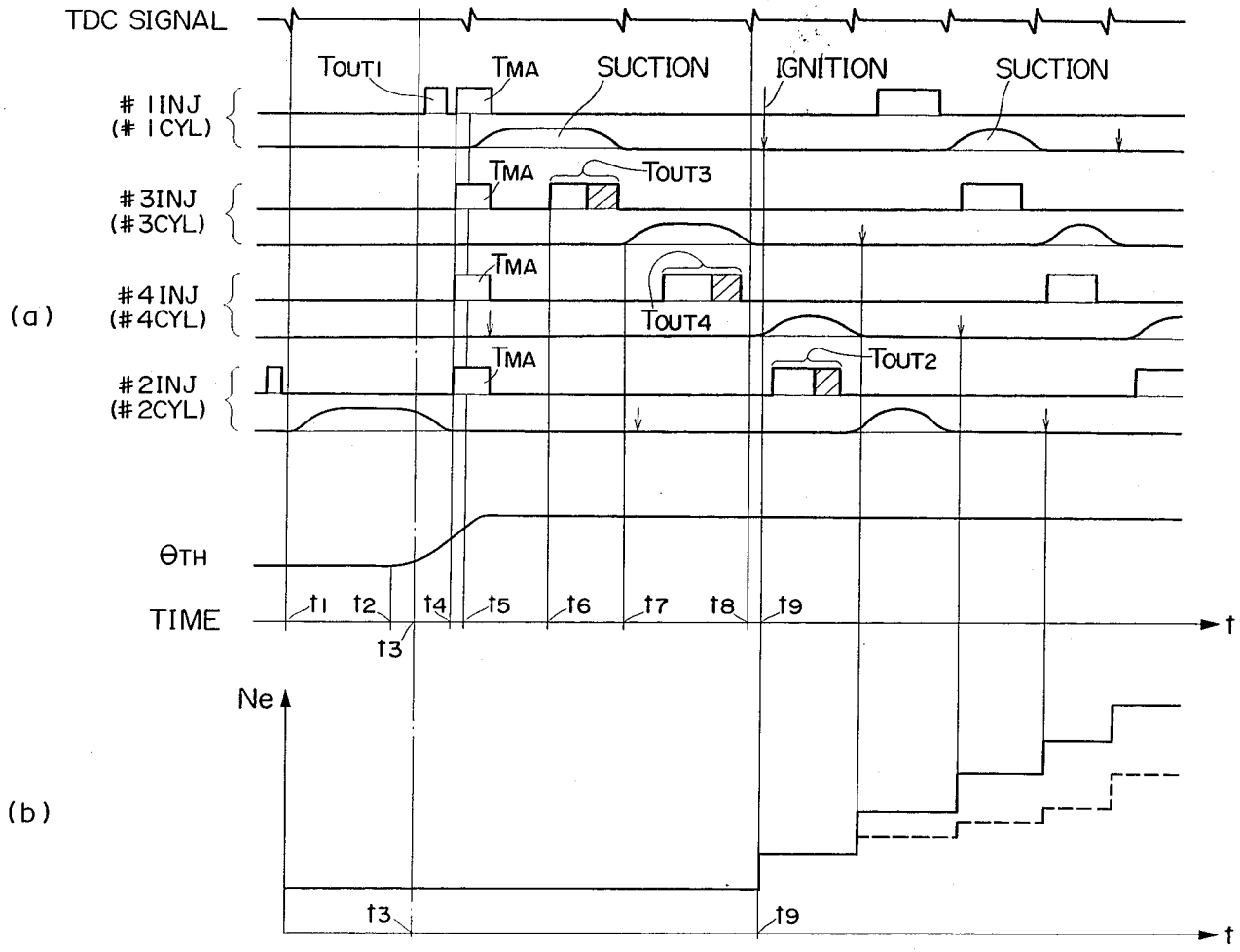
FIG. 2 is a timing chart showing the relationship between the timing of opening of fuel injection valves for respective engine cylinders and changes in the engine rotational speed with the lapse of time.

FIG. 2 shows the relationship between the timing of opening of fuel injection valves 4 or #1INJ–#4INJ for the respective cylinders #1CYL–#4CYL and changes in the engine rotational speed Ne with the lapse of time, which is assumed when the engine is accelerated from an idling condition into a predetermined accelerating condition.

As shown in FIG. 2, if the predetermined accelerating condition of the engine is detected (between time points t2–t3 in FIG. 2) wherein the throttle valve opening $\theta$th suddenly changes before generation of a pulse of the TDC signal corresponding to the suction stroke of the first cylinder #1CYL (at time point t5 in FIG. 2), a fuel quantity to be injected by the asynchronous fuel injection control is calculated in synchronism with generation of a pulse of a clock signal which has a fixed pulse repetition period (e.g. 10 msec) generated immediately after the detection of the predetermined accelerating condition, and accelerating fuel increments TMA required for acceleration of the engine are supplied to all the cylinders #1CYL–#4CYL at the same time (at t4 in FIG. 2). In the illustrated example, the cylinder #1CYL is supplied with a fuel quantity TOUT1 according to the synchronous fuel injection during the suction stroke commencing at the time point t5. Since this fuel quantity TOUT 1 was calculated at the time of generation of an immediately preceding pulse of the TDC signal (at t1 in FIG. 2 when the engine was in an idling condition), the engine output can be increased with high responsiveness to additional supply of the accelerating fuel increments TMA to the first cylinder #1CYL, as seen at a time point t9 in FIG. 2. Next, in respect of the third cylinder #3CYL which executes the suction stroke immediately following the suction stroke of the first cylinder #1CYL, the asynchronous accelerating fuel increment TMA injected at the time point t4 stays within a downstream portion of the intake pipe 2 and becomes gradually atomized to be drawn into the third cylinder #3CYL during the suction stroke thereof commencing at a time point t7. However, a fuel quantity TOUT3 injected for the third cylinder #3CYL at a time point t6 according to the synchronous fuel injection already has an increased value suitable for accelerating the engine, since the calculation of the fuel quantity TOUT3 is effected at the time of generation of a TDC signal pulse at the time point t5 in response to an operating condition of the engine then assumed. Therefore, as all the total amount of TOUT3 and TMA is sucked into the third cylinder #3CYL during the suction stroke commencing at t7, the resulting mixture in the cylinder #3CYL becomes overrich. As a result, there takes place a so-called panting phenomenon that the rate of increase in the engine rotational speed temporarily drops as indicated by the broken line in (b) of FIG. 2. Also the second and fourth cylinders #2CYL and #4CYL undergoes the same phenomenon as the third cylinder #3CYL.

To overcome this disadvantage, according to the invention, after simultaneous injection of asynchronous accelerating fuel increments (TMA) into all the cylinders according to the asynchronous fuel injection upon detection of the predetermined accelerating condition of the engine (e.g. at time point t4 in FIG. 2), a fuel quantity (TOUT2–TOUT4) for the synchronous fuel injection calculated in synchronism with generation of each of pulses of the TDC signal generated immediately after the above asynchronous fuel injection (at time points t5 et seq) is decreased by a predetermined amount as hatched in FIG. 2, preferably over a predetermined period of time (e.g. from the time of generation of a TDC signal pulse at t5 to one at t8).

Figure 3:
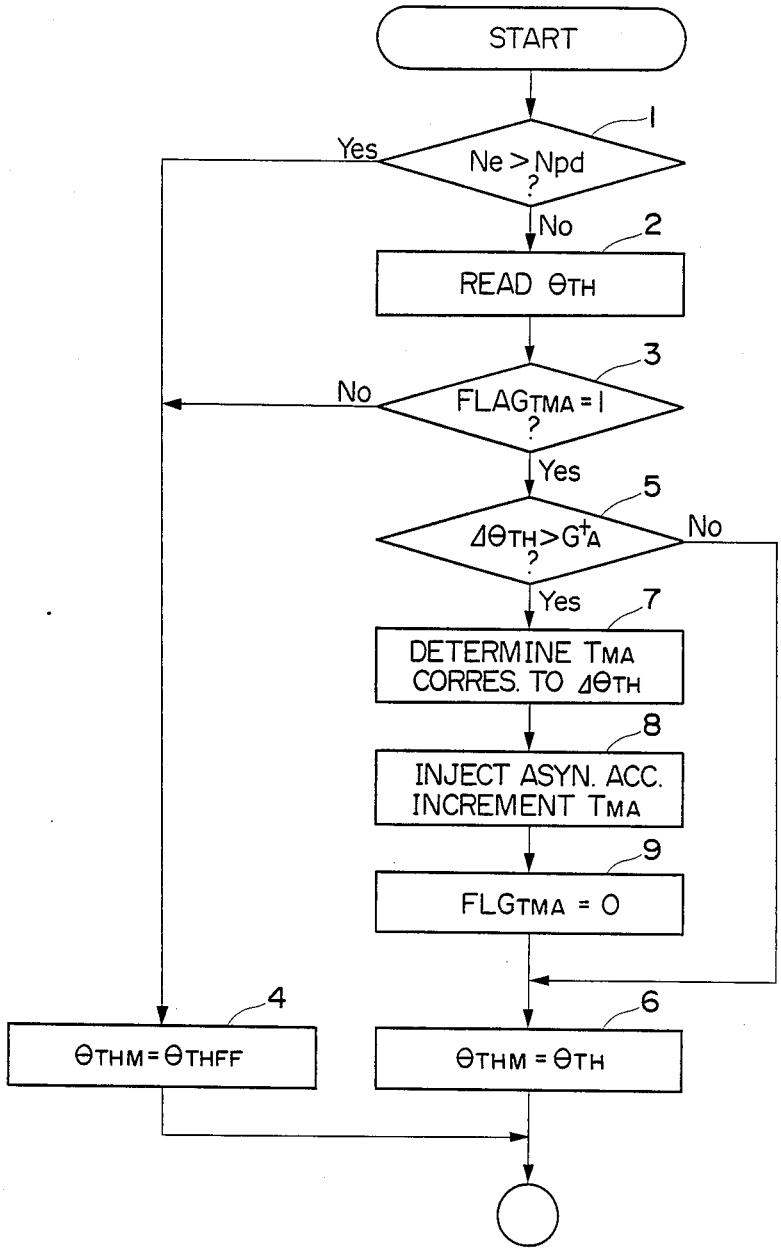
FIG. 3 is a flowchart showing a program for carrying out the asynchronous fuel injection control executed by a CPU 8*b* appearing in FIG. 1.

FIG. 3 shows a flowchart of a control program for carrying out the asynchronous fuel injection control for determining the asynchronous accelerating fuel increment TMA according to the invention. This program is executed in synchronism with generation of each pulse of a clock signal having a fixed pulse repetition period (e.g. 10 msec) by the CPU 8*b* in FIG. 1.

Figure 4:
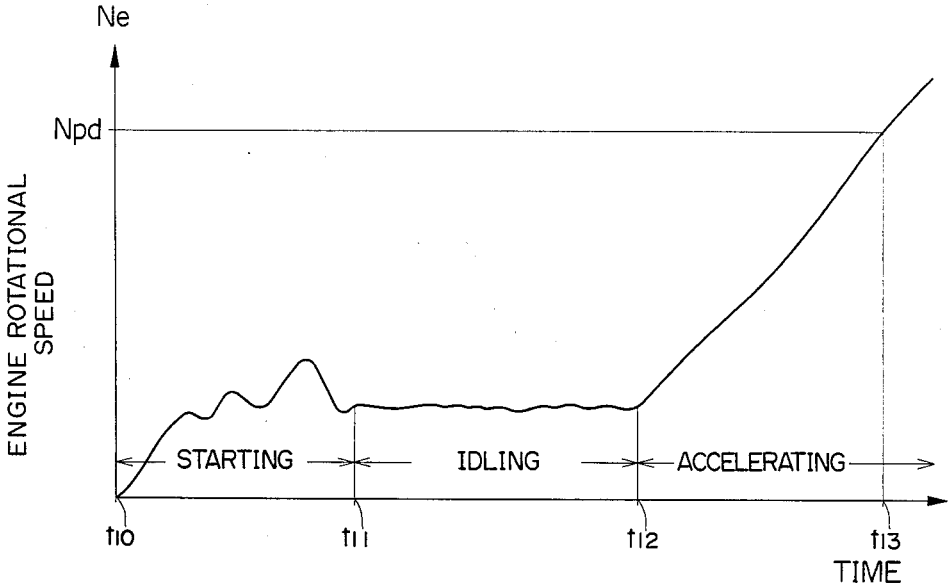
FIG. 4 is a timing chart showing changes in the engine rotational speed with the lapse of time.

The program of FIG. 3 will now be explained with reference to the timing chart of FIG. 4 showing changes in the engine rotational speed Ne with respect to the lapse of time.

During starting of the engine (between time points t10–t11 in FIG. 4), upon generation of a clock pulse after each lapse of a predetermined period of time tAP (e.g. 10 msec), a determination is made, at a step 1, as to whether or not the engine rotational speed Ne is higher than a predetermined value Npd (e.g. 1500 rpm). Since at this point of time, the engine rotational speed Ne has not yet risen to a sufficient level, the answer to the question of the step 1 should be negative or No, and then the program proceeds to a step 2. In the step 2, a value of the throttle valve opening θth sensed in the present loop is read in. Then at a step 3 it is determined whether or not a flag FLGTMA for discriminating whether the asynchronous fuel increment is permissible assumes a value of 1. This discriminating flag is set to 0 or 1 in response to operating conditions of the engine during execution of a control program for carrying out synchronous fuel injection control in synchronism with generation of TDC signal pulses, shown in FIG. 5, and during starting of the engine it is set to 0 as an initial value.

Since as stated hereinafter the discriminating flag FLGTMA is held at 0 until the engine is brought into an idling condition following the starting thereof, at this time the answer to the question of the step 3 should be negative or No, and then the program proceeds to a step 4.

In the step 4, a throttle valve opening value θTHM to be stored in the present loop is set to the maximum value θTHFF, followed by termination of the program.

When the engine is brought into the idling condition for the first time after being started (at time point t11 in FIG. 4), the discriminating flag FLGTMA is set to 1 in accordance with the synchronous fuel injection control program of FIG. 5 executed at every generation of TDC signal pulse, as hereinafter described, and accordingly the answer to the question of the step 3 then becomes affirmative or Yes. Then the program proceeds to a step 5 wherein it is determined whether or not a rate of change ΔθTH in the throttle valve opening (θTH–θTHM) between the last loop and the present loop is larger than a predetermined value GA+ with reference to which it is determined whether the engine is being accelerated. Since the stored value θTHM of the throttle valve opening has been set to the maximum value θTHFF in the last loop (during starting of the engine), the answer to the question of the step 5 becomes negative or No in the present loop. Hence a step 6 is exeucted to replace the stored value θTHM by a detected value θTH of throttle valve opening obtained in the present loop (during idling of the engine), followed by termination of the program.

So long as the engine is still determined to be operating in the idling condition in the subsequent loops (from t11 to t12 in FIG. 4) wherein the throttle valve opening θTH should remain almost constant, the rate of change ΔθTH should remain below the predetermined value GA+ so that the answer to the question of the step 5 continues to be negative or No, and then the program proceeds to the step 6 to set the stored value θTHM to the detected value θTH, followed by termination of the program.

If the accelerator pedal is suddenly stepped on while the engine is operating in the idling condition (at t12 in FIG. 4), the rate of change ΔθTH in the throttle valve opening exceeds the predetermined value GA+ in the immediately following loop, and accordingly the answer to the question of the step 5 becomes affirmative or Yes, whereby steps 7 and 8 are executed to carry out the asynchronous fuel injection control of increasing fuel quantity at engine acceleration.

Figure 6:
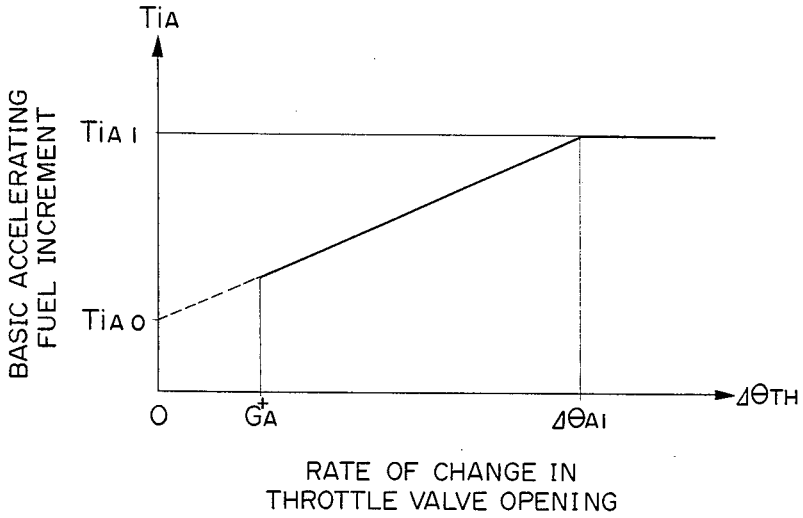
FIG. 6 is a view showing a table of the relationship between a rate of change in the opening of a throttle valve and a basic fuel increment TiA.

First, at the step 7, the asynchronous accelerating fuel increment TMA is calculated by the use of the following equation:

$$TMA = TiA + Tv \quad (1)$$

where TiA represents a basic accelerating fuel increment which is read out from a ΔθTH–TiA table shown in FIG. 6 in response to the rate of change ΔθTH in the throttle valve opening, and Tv a variable for correcting the valve opening period as a function of a change in the driving voltage applied to the fuel injection valves for opening same.

At the next step 8, all the fuel injection valves #1INJ–#4INJ are opened at the same time over a valve opening period corresponding to the accelerating fuel increment TMA obtained in the step 7, and then a step 9 is executed to set the discriminating flag FLGTMA to 0. This step 9 is effective to prohibit the asynchrnous fuel injection from being carried out more than one time per each acceleration. The step 9 is followed by execution of the step 6 and then termination of the program.

Thereafter, even if the engine is determined to remain in the accelerating condition (ΔθTH>GA+) in the subsequent loops, no more asynchronous fuel injection is carried out since the discriminating flag FLGTMA has been set to 0 at the step 9, followed by termination of the program.

In the subsequent steps, even if the engine still stays in the accelerating condition (ΔθTH>GA+), no further asynchronous fuel ingjetion is effected since the discriminating flag FLGTMA has been set to 0 in the steg P, immediately followed by terminatin of the program.

When the engine rotational speed Ne rises above the aforementioned predetermined value Npd while the engine is in the accelerating condition at and after t13 in FIG. 4, the answer to the question of the step 1 becomes affirmative or Yes, so that the step 4 alone is executed, followed by termination of the program.

Figure 5:
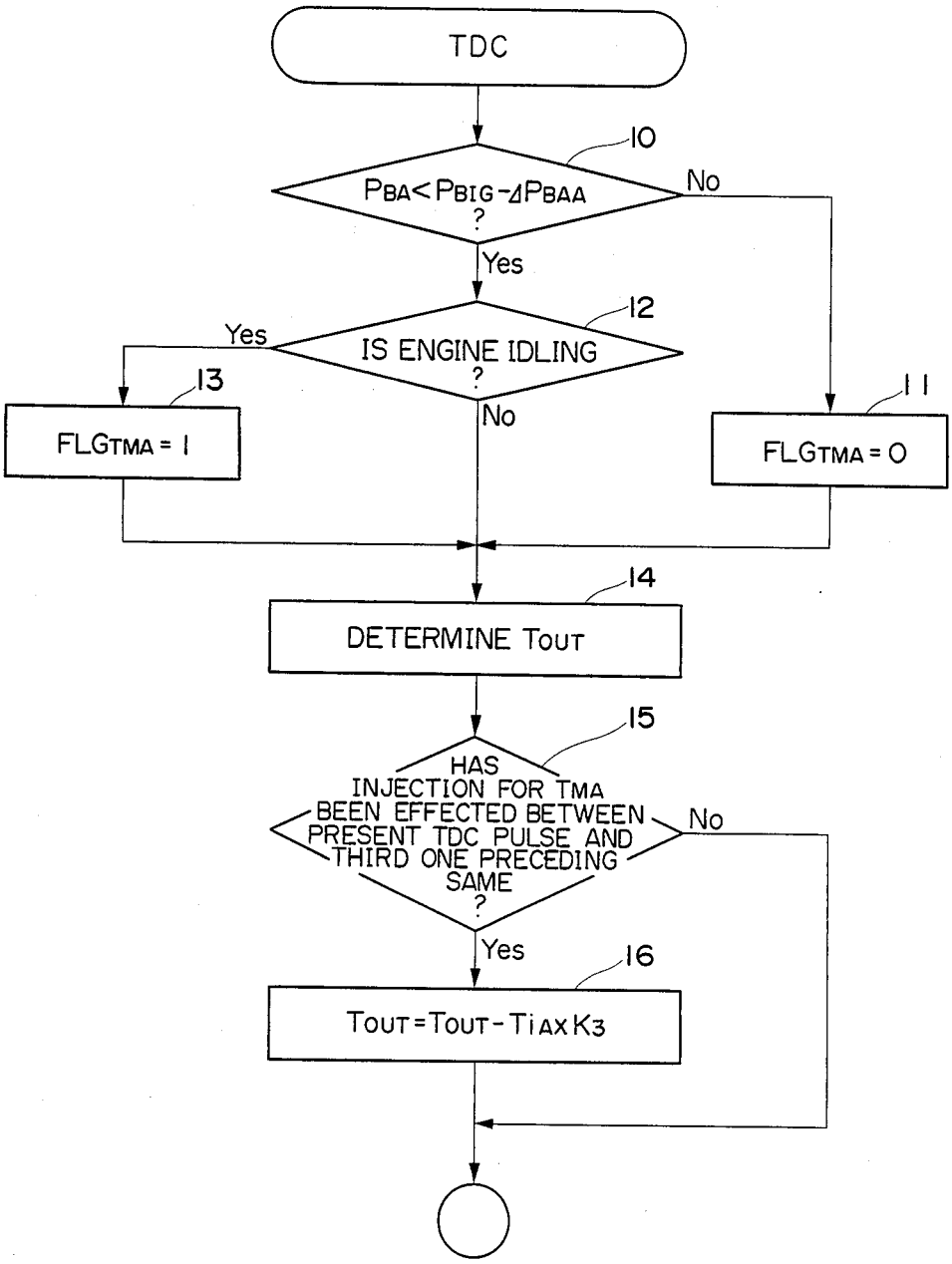
FIG. 5 is a flowchart showing a program for carrying out the synchronous fuel injection control executed by the CPU 8*b* in FIG. 1.

Next, the synchronous fuel injection control, which is executed at every generation of TDC signal pulse, will be explained with reference to FIG. 5 showing a flowchart of a program for executing the same control.

Upon generation of each TDC signal pulse, a step 10 is called for wherein it is determined whether or not a value of intake pipe absolute pressure PBA detected at the time of generation of the each TDC signal pulse has decreased below a differential valve obtained by subtracting a predetermined value ΔPBAA from a value PBAON of intake pipe absolute pressure detected at the time of closing the ignition switch of the engine. This step 10 serves to prohibit the asynchronous fuel injection control or asynchronous accelerating fuel increment from being carried out when the accelerator pedal is stepped on before the engine is started just after the power switch for the ECU 8 has been turned on. That is, the step 10 is effective to allow the asynchronous accelerating fuel increment to be carried out only after the engine has been brought into a completely fired state (self-operating state) through starting operation. The predetermined value ΔPBAA is set at a value corresponding to a pressure drop from atmospheric pressure (PBAON) due to complete firing of the engine. If the answer to the question of the step 10 is negative or No, it is judged that the engine has not yet reached the completely fired state, and then the program proceeds to a step 11 to set the discriminating flag FLGTMA to 0 to thereby prohibit the asynchronous fuel injection from being carried out, followed by execution of the steps 14 et seq.

On the other hand, if the answer to the question of the step 10 is affirmative or Yes, that is, if the engine is determined to have been completely fired, a step 12 is called for to determine whether the engine has reached an idling state. If the answer is affirmative or Yes, the discriminating flag FLGTMA is set to 1 at a step 13, while if the answer is negative or No, the program skips over the step 13 and proceeds direct1y to the step 14.

By thus setting the discriminating flag FLGTMA to 1 each time the engine enters an idling condition, the asynchronous fuel injection control or asynchronous accelerating fuel increment is effected only when the engine shifts from an idling condition into an accelerating condition. Further, even after the asynchronous fuel increment has been effected, if the engine is then brought into an idling condition followed by entering an accelerating condition, the asynchronous accelerating fuel increment is permitted.

In the step 14, a fuel injection quantity TOUT is calculated in accordance with the synchronous fuel injection control by the use of the following equation (2):

$$TOUT = Ti \times Kl + K2 \quad (2)$$

where Ti represents a basic fuel injection period, as a basic value of fuel quantity supplied to the engine, which is read out from among a plurality of predetermined values as a function of intake pipe absolute pressure PBA and engine rotational speed Ne, stored in the memory means 8*c* within the ECU 8, in response to detected PBA and Ne values. Kl and K2 represent correction coefficients and correction variables, respectively, set as a function of various engine operating parameters so as to optimize engine operating characteristics such as fuel consumption, exhaust emission characteristics and driveability.

Referring again to FIG. 5, the step 14 is followed by a step 15 wherein it is determined whether or not the asynchronous accelerating fuel injection control or asynchronous fuel increment has been effected between the time of generation of a present TDC signal pulse and the time of generation of a third one preceding the present one. If the answer is affirmative or Yes, it is judged that an amount of fuel corresponding to the asynchronous accelerating fuel increment TMA is still present within a cylinder into the fuel amount TOUT calculated at the time of generation of the present TDC signal pulse is to be injected (i.e. a cylinder which is to start its suction stroke at the time of generation of the next TDC signal pulse), and then program proceeds to a step 16, while if the answer is negative or No, the program is immediately terminated.

In the step 16, the fuel amount TOUT determined at the step 14 is decreased by a product of the basic accelerating increment TiA determined by the program for the asynchronous fuel injection control and a fixed value K3 (e.g. 1.0) to obtain a new fuel injection quantity:

$$TOUT = TOUT - TiA \times K3 \quad (3)$$

The reason why the basic accelerating fuel increment TiA is used for correction of the fuel injection quantity TOUT at the step 16 is that the fuel increment TiA is substantially equal to an actual increase in the fuel quantity supplied to the engine at acceleration due to execution of the asynchronous fuel injection control. The coefficient K3 may be set at values other than 1.0, appropriate to operating characteristics of individual engines to be applied.

Although in the foregoing embodiment the asynchronous fuel injection control is effected only one time per each acceleration of the engine, this is not limitative to the invention, but it may be effected more than one time per each engine acceleration according to necessity insofar as both the asynchronous fuel injection control and the synchronous fuel injection control are employed.

What is claimed is:

1. A method of controlling the injection of fuel into an internal combustion engine having a plurality of cylinders, wherein synchronous fuel injection is effected in synchronism with control pulses generated at predetermined crank angle positions of said engine corresponding to suction strokes of respective ones of said cylinders to supply each of said cylinders with a quantity of fuel required for operating conditions of said engine, and when said engine is operating in a predetermined accelerating condition, asynchronous fuel injection is effected independently of said control pulses to supply each of said cylinders with an additional quantity of fuel, the method comprising the step of decreasing said quantity of fuel to be supplied to said engine by said synchronous fuel injection, by a predetermined amount corresponding to the quantity of fuel to be supplied by said asynchronous fuel injection, immediately after said asynchronous fuel injection is effected.

2. A method of controlling the injection of fuel into an internal combustion engine having a plurality of cylinders, wherein synchronous fuel injection is effected in synchronism with control pulses generated at predetermined crank angle positions of said engine corresponding to suction strokes of respective ones of said cylinders to supply each of said cylinders with a quantity of fuel required for operating conditions of said engine, and when said engine is operating in a predetermined accelerating condition, asynchronous fuel injection is effected independent1y of said control pulses to supply each of said cylinders with an additional quantity of fuel, the method comprising the steps of:

(1) immediately after said asynchronous fuel injection is effected, determining a required quantity of fuel to be supplied to said engine by said synchronous fuel injection, in accordance with at least one operating condition parameter of said engine;

(2) after said required quantity of fuel has been determined and before resumption of said synchronous fuel injection, decreasing said required quantity of fuel by a predetermined amount independent of said operating condition parameter of said engine; and (3) supplying the decreased value of said required quantity of fuel to said engine by synchronous fuel injection for a limited period of time after said asynchronous fuel injection has been effected.

3. A method as claimed in claim 2, wherein said predetermined amount of fuel corresponds to said quantity of fuel to be supplied by said asynchronous fuel injection.

4. A method as claimed in claim 3, wherein said predetermined amount of fuel is equal to a product obtained by multiplying a basic value of said quantity of fuel to be supplied by said asynchronous fuel injection by a predetermined value.

5. A method as claimed in claim 2, wherein said synchronous fuel injection comprises sequentially injecting fuel into said cylinders in predetermined sequence, and said asynchronous fuel injection comprises injecting fuel into all said cylinders at the same time, said quantity of fuel to be supplied by said synchronous fuel injection to each of said cylinders which has a suction stroke thereof immediately following said asynchronous fuel injection is decreased by said predetermined amount.

6. A method as claimed in claim 5, wherein said quantity of fuel to be supplied by said synchronous fuel injection to each of said cylinders is decreased by said predetermined amount if said each of said cylinders has a suction stroke thereof immediately following said asynchronous fuel injection such that said additional quantity of fuel to be supplied by said asynchronous fuel injection and said quantity of fuel to be supplied by said synchronous fuel injection are sucked together into said each of said cylinders during said suction stroke thereof.

7. A method as claimed in claim 2, wherein said predetermined accelerating condition of said engine is one taking place while said engine is in an idling condition.

* * * * *